US006528221B2

(12) United States Patent
Takezawa et al.

(10) Patent No.: US 6,528,221 B2
(45) Date of Patent: Mar. 4, 2003

(54) FLASH FIXING TONER AND FABRICATION METHOD THEREFOR

(75) Inventors: Satoshi Takezawa, Kawasaki (JP); Yasushige Nakamura, Kawasaki (JP); Yoshimichi Katagiri, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/818,524

(22) Filed: Mar. 28, 2001

(65) Prior Publication Data

US 2002/0061456 A1 May 23, 2002

(30) Foreign Application Priority Data

Nov. 21, 2000 (JP) ..... 2000-354896

(51) Int. Cl.[7] ..... G03G 9/09

(52) U.S. Cl. ..... 430/108.21; 430/108.2; 430/108.8; 430/108.4; 430/108.1; 430/110.1

(58) Field of Search ..... 430/110.1, 108.2, 430/108.8, 108.4, 108.1, 108.21

(56) References Cited

U.S. PATENT DOCUMENTS 3,558,881 A * 1/1971 Gold ..... 250/65
4,699,863 A 10/1987 Sawatari et al.
5,582,950 A 12/1996 Katagiri et al.
5,814,427 A * 9/1998 Murofushi et al. ..... 430/110.1

FOREIGN PATENT DOCUMENTS

| | | | |
|---|---|---|---|
| JP | 61-132959 | | 6/1986 |
| JP | 62166356 A | * | 7/1987 |
| JP | 62166357 A | * | 7/1987 |
| JP | 5-16299 | | 1/1993 |
| JP | 7-191492 | | 7/1995 |
| JP | 8-15892 | | 1/1996 |
| JP | 9-22147 | | 1/1997 |
| JP | 9-258471 | | 10/1997 |

OTHER PUBLICATIONS

Derwent Acc. No. 1987–245440. (1987).*
Diamond, Arthur S. (editor) Handbook of Imaging Materials. New York: Marcel–Dekker, Inc. p. 161. (1991).*

* cited by examiner

*Primary Examiner*—Christopher Rodee
(74) *Attorney, Agent, or Firm*—Armstrong, Westerman, & Hattori, LLP

(57) ABSTRACT

A flash fixing toner includes a binder resin, a coloring agent, a charge control agent, a wax, and an infrared ray absorbing agent. The infrared ray absorbing agent is held within the wax, so as to suppress contact between the infrared ray absorbing agent and the charge control agent.

9 Claims, 1 Drawing Sheet

FLASH FIXING TONER AND FABRICATION METHOD THEREFOR

BACKGROUND OF THE INVENTION

This application claims the benefit of a Japanese Patent Application No.2000-354896 filed Nov. 21, 2000, in the Japanese Patent Office, the disclosure of which is hereby incorporated by reference.

1. Field of the Invention

The present invention generally relates to flash fixing toners used to visualize electrostatic latent images which are formed by the electrophotography technique and fabrication methods therefor, and more particularly to a flash fixing toner in which an infrared ray absorbing agent is selectively held within a wax and to a fabrication method for fabricating the flash fixing toner.

In image forming apparatuses which employ the electrophotography technique, such as copying machines and printers, it is becoming more popular to make color images. Accordingly, there are demands to improve the image quality which can be obtained and to reduce the cost when using color toners to form color images by flash fixing.

2. Description of the Related Art

According to the electrophotography technique, a uniform electrostatic charge is applied on a photoconductive insulator such as a photoconductive drum, and various means can be used to irradiate an optical image on the photoconductive insulator to thereby form an electrostatic latent image. Then, a toner is used to visualize the electrostatic latent image into a toner image. The toner image is transferred onto a recording medium such as paper, and subjected to a predetermined fixing process to obtain a print having the toner image fixed on the recording medium.

During the fixing process, the toner image on the recording medium is melted and fixed by applying pressure, heat, vapor solvent, light or the like. Of such methods of melting and fixing the toner image, much attention is drawn to the optical fixing method for the following reasons.

First, since the optical fixing method does not require contact to be made with the toner image on the recording medium, the image is unaffected by runs, foreign particles and the like during the fixing process, thereby making it possible to obtain a clear image having a high resolution.

Second, it is unnecessary to wait for a long time after the power of the image forming apparatus is turned ON because there is no need to preheat heater elements or the like, thereby making it is possible to make a quick-start of the image forming apparatus.

Third, even when the recording medium such as paper is jammed within the fixing unit due to a failure of the image forming apparatus, there is no possibility of the recording medium being heated to an extreme and catching fire because the optical fixing method does not require contact to be made with the recording medium, thereby ensuring safe operation of the image forming apparatus.

Fourth, it is possible to carry out the fixing process with respect to various kinds of recording media made of various materials and having various thicknesses, such as sticking paper, preprinted paper and papers of different thicknesses, since the optical fixing method does not require contact to be made with the recording medium.

Generally, the optical fixing method uses xenon flash lamp as the light source to carry out a flash fixing process.

But since the flash fixing process transforms optical energy into thermal energy in order to melt and fix the toner, a poor fixing occurs if the melting of the toner is insufficient. When such a poor fixing occurs, the fixed toner image easily separates from the recording medium when the recording medium is bent or the fixed toner image is rubbed, to thereby deteriorate the quality of the image. In order to prevent such a deterioration of the image quality due to the poor fixing, the toner which is used in the flash fixing process must be designed to absorb the optical energy and sufficiently melt, and to positively permeate the recording medium and to be positively fixed on the recording medium.

In the flash fixing method which uses the xenon flash lamp, the toner is melted by the optical energy of the light having a high intensity in the infrared region. Hence, in this case, the toner must be designed to have an improved infrared absorption so that the toner will sufficiently melt when irradiated with the light having the high intensity in the infrared region.

In the case of black toners, carbon is generally used as the coloring agent. Since carbon has a good light absorption over a wide wavelength region, the light absorption itself of the black toner does not become a problem. Hence, as the measures to be taken to improve the fixing performance of the black toner, the main object is to make the black toner easy to melt, and a highly soluble wax is added as such measures, as proposed in Japanese Laid-Open Patent Applications No.9-22147 and No.9-258471, for example.

On the other hand, in the case of color toners, the light absorption is inevitably lower than that of the black toners, and a poor fixing is more likely to occur in the case of the color toners. Hence, when designing the color toner, it is not only necessary to make the toner easy to melt as in the case of the black toner, but also to improve the light absorption of the color toner.

For example, a Japanese Laid-Open Patent Application No. 61-132959 proposes a method of improving the infrared absorption of the color toner by adding to the color toner an infrared ray absorbing agent which is made of an aminium-salt-based compound and a diimonium-salt-based compound. Generally, a compound having a high infrared absorption has a hue ranging from brown to black. However, since the aminium-salt-based compound or the like not only has a high infrared absorption but is also capable of indicating a light color tone in the visible region, the effect on the original hue of the color toner is small, and the aminium-salt-based compound or the like is considered a good additive for supplementing the light absorption of the color toner.

The infrared ray absorbing agent such as the aminium-salt-based compound is an ionic compound having a high polarity. For this reason, the aminium-salt-based compound or the like has a high compatibility with resins such as polyester and styrene-acrylic which also have a high polarity and are generally used as a binder resin of the toner. In addition, a charge control agent is added to the toner to control the charge thereof, and this charge control agent also has a polarity. Accordingly, when the infrared ray absorbing agent and the charge control agent both having polarities contact each other within the binder resin, a reaction may cause undesirable effects on the charge control characteristic of the toner.

Furthermore, the infrared ray absorbing agent deteriorates the resulting infrared absorption. In order to obtain a desirable fixing performance of the color toner, it is necessary to add a large amount of infrared ray absorbing agent in the toner, but this affects the hue of the toner even when a light colored infrared ray absorbing agent such as the aminium-salt-based compound is used. Moreover, the fabrication cost of the toner becomes high when a large amount of infrared ray absorbing agent is added to the toner.

SUMMARY OF THE INVENTION

Accordingly, it is a general object of the present invention to provide a novel and useful flash fixing toner and fabrication method therefor, in which the problems described above are eliminated.

Another and more specific object of the present invention is to provide a flash fixing toner having a good charge control characteristic, a high infrared absorption and a relatively low cost, and capable of realizing a flash fixing process which obtains a high-quality image which is satisfactorily fixed, and a fabrication method for fabricating such a flash fixing toner.

Still another object of the present invention is to provide a flash fixing toner comprising a binder resin, a coloring agent, a charge control agent, a wax, and an infrared ray absorbing agent, where the infrared ray absorbing agent is held within the wax. According to the flash fixing toner of the present invention, the infrared ray absorbing agent is selectively held within the wax, and the contact between the infrared ray absorbing agent and the charge control agent is suppressed. For this reason, both the infrared ray absorbing agent and the charge control agent can sufficiently exhibit the respective original functions. As a result, the charge control characteristic of the toner becomes satisfactory, and the infrared absorption becomes satisfactory to positively melt the toner upon infrared ray irradiation. Consequently, the toner can realize a high resolution and a high fixing performance. On the other hand, since the infrared ray absorbing agent and the charge control agent will not mutually react and cause mutual deterioration, it is possible to suppress the amount of these agents to be added to the toner, to thereby enable the cost of the toner to be reduced.

The wax may be dotted in a form of islands within the binder resin. In addition, the wax may be made of a material or a mixture of materials selected from a group of polyolefins, fatty esters, paraffin wax, carnauba wax, amide-based wax and acid-converted polyethylene. In these cases, the possibility of contact between the infrared ray absorbing agent and the charge control agent is greatly reduced when compared to the conventional case where the infrared ray absorbing agent is randomly dispersed.

The infrared ray absorbing agent may be made of an aminium-salt-based compound and or a diimonium-salt-based compound. In this case, it is possible to positively melt the toner upon infrared ray irradiation.

Further, the flash fixing toner may further comprise a surface-active agent within the wax. In this case, it is possible to realize a state where the surface-active agent functions to hold the infrared ray absorbing agent having polarity within the wax.

A further object of the present invention is to provide a fabrication method for fabricating a flash fixing toner, comprising a first step which melts and mixes a wax, an infrared ray absorbing agent and a surface-active agent to obtain a mixture, and forms the mixture into a powder of wax grains including the infrared ray absorbing agent, and a second step which mixes the wax grains including the infrared ray absorbing agent, a binder resin, a coloring agent and a charge control agent, and forms a powder of color toner grains forming the flash fixing toner. According to the fabrication method of the present invention, it is possible to fabricate a toner which can realize a high resolution and a high fixing performance.

Other objects and further features of the present invention will be apparent from the following detailed description when read in conjunction with the accompanying drawings.

DESCRIPTION OF THE PREFERRED EMBODIMENTS

Figure 1:
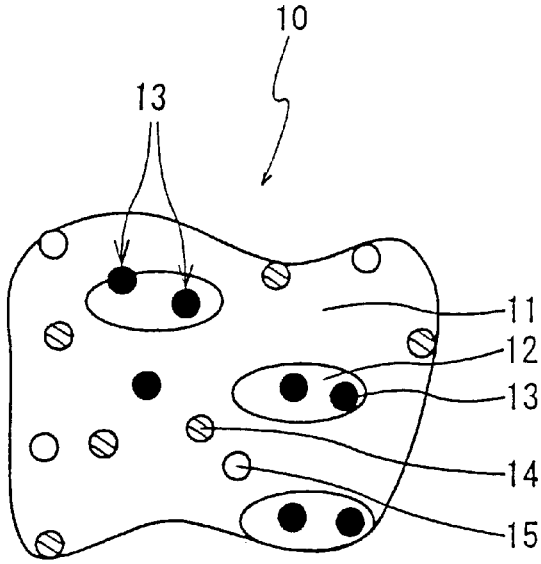
FIG. 1 is a diagram, on an enlarged scale, showing a general structure of one grain of a flash fixing toner according to the present invention.

A description will be given of a flash fixing toner according to the present invention, by referring to FIG. 1. FIG. 1 is a diagram, on an enlarged scale, showing a general structure of one grain of the flash fixing toner according to the present invention. As will be described later, a flash fixing color toner (hereinafter simply referred to as a color toner) 10 shown in FIG. 1 includes a binder resin 11, a wax 12, an infrared ray absorbing agent 13, a coloring agent 14, and a charge control agent 15.

Figure 2:
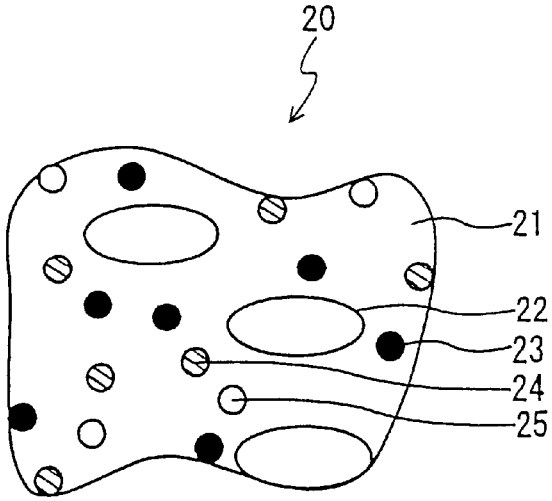
FIG. 2 is a diagram, on an enlarged scale, showing a general structure of one grain of a conventional flash fixing toner.

For comparison purposes, FIG. 2 is a diagram, on an enlarged scale, showing a general structure of one grain of a conventional flash fixing toner. A flash fixing color toner 20 shown in FIG. 2 includes a binder resin 21, a wax 22, an infrared ray absorbing agent 23, a coloring agent 24, and a charge control agent 25.

An infrared ray absorbing agent having a high infrared absorption is an ionic compound in most cases and has a high polarity. In addition, resins such as polyester and styrene-acrylic which are generally used as a binder resin of the toner also have a high polarity. For this reason, as in the case of the conventional color toner 20 shown in FIG. 2, the infrared absorbing agent 23 and the binder resin 21 generally have a high compatibility. In addition, the charge control agent 25 which is added to the conventional color toner 20 to control the charge thereof also has a polarity. Accordingly, in a state where the infrared ray absorbing agent 23 and the charge control agent 25 are mixed within the binder resin 21, the infrared ray absorbing agent 23 and the charge control agent 25 mutually react, and this reaction causes both the infrared absorption and the charge control characteristic to deteriorate.

On the other hand, because the infrared ray absorbing agent 23 is a highly polar material, it is difficult to disperse the infrared ray absorbing agent 23 within the wax 22 which is made of a non-polar material or a material having a low polarity such as polyolefin. The present inventors attempted to mix the wax 22 and the infrared ray absorbing agent 23 by a normal melting and mulling method, but it was confirmed that the two materials will separate from each other and that the infrared ray absorbing agent 23 cannot be held within the wax 22.

Accordingly, the present inventors conducted experiments to devise a structure which would hold the infrared ray absorbing agent within the wax. As a result, it was found that the infrared ray absorbing agent can be held within the wax if the interface of the wax and the infrared ray absorbing agent is activated. In other words, it was confirmed that a state can be achieved in which the infrared ray absorbing agent is held within the wax, by adding a surface-active agent to the infrared ray absorbing agent. It was also confirmed that sorbitane fatty group ester, polyether, polyol, alkyl- polyoxyethylene-based surface-active agent, alkylphenyl-polyoxyethylene-based surface-active agent and the like, for example, may be used as the surface-active agent.

In other words, in the color toner 10 shown in FIG. 1, the infrared ray absorbing agent 13 is held within the wax 12. The color toner 10 is maintained in a state where the infrared ray absorbing agent 13 is selectively embedded within the wax 12 and/or partially exposed from the surface of the wax 12. Because the infrared ray absorbing agent 12 is suppressed from being exposed at the surface of the color toner 10, the possibility of the infrared ray absorbing agent 12 making contact with the charge control agent 15 is greatly reduced to thereby suppress deterioration of the charge control characteristic of the charge control agent 15. In addition, it is also possible to suppress deterioration of the infrared absorption of the infrared ray absorbing agent 13. Accordingly, the charge control agent 15 and the infrared ray absorbing agent 13 which are added to the color toner 10 will not deteriorate, and both the original charge control characteristic and infrared absorption can be maintained. Therefore, compared to the conventional color toner 20 shown in FIG. 2, the color toner 10 according to the present invention can realize a good charge control characteristic, a high infrared absorption and a relatively low cost, and realize a flash fixing process which obtains a high-quality color image which is satisfactorily fixed.

Next, a description will be given of the materials forming the various constituent elements of the color toner 10.

First, a description will be given of the infrared ray absorbing agent 13. The infrared ray absorbing agent 13 of the color toner 10 is desirably made of an aminium-salt-based compound described by the following formula (1) and/or a diimonium-salt-based compound described by the following formula (2).

(1)

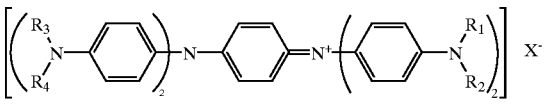

(2)

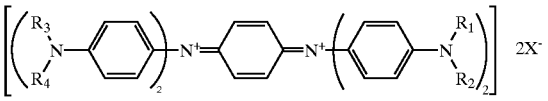

In the formulas (1) and (2) above, R1 through R4 denote hydrogen atom, alkyl group, substitution alkyl group, cyclic alkyl group, alkenyl group, alalkyl group or substitution alalkyl group, and $X^-$ denotes negative ion.

The aminium-salt-based compound and the diimonium-salt-based compound have a high infrared absorption and a light color which virtually does not affect the hue of the fixing image. Furthermore, since the amount of the infrared ray absorbing agent 13 to be added to the color toner 10 can be suppressed for the reasons described above, it becomes unnecessary to take into consideration the effects on the hue.

For example, compounds CIR-960, CIR-961, CIR-963, CIR-1080, CIR-1081 and CIR-1083 manufactured by Nihon Karlit Company of Japan may be used for the infrared ray absorbing agent 13.

The wax 12 is made of a material having a low polarity or by a non-polar material. The material forming the wax 12 may be polyolefins such as polyethylene and polypropylene, fatty esters, paraffin wax, carnauba wax, amide-based wax, acid-converted polyethylene, or an appropriate mixture thereof. From the point of view of improving and supplementing the fixing performance of the color toner 10, it is desirable that the softening temperature of the wax 12 is approximately 150° C. or less, and it is particularly desirable that the wax 12 has a softening temperature lower than a melting temperature of the binder resin 11.

The surface-active agent described above may be made of sorbitane fatty group ester. It is desirable that the hydrophile-lypophile balance (HLB) value of the sorbitane fatty group ester is 8 or less. As described above, it may be regarded that the surface-active agent exists at the interface of the wax 12 and the infrared ray absorbing agent 13, and functions to hold the infrared ray absorbing agent 13 within the wax 12. In addition, it may be regarded that the surface-active agent also exists at the interface of the wax 12 and the binder resin 11, and helps the wax 12 which has low or no polarity to be dotted in a form of islands within the binder resin 11 which has the high polarity.

The material used for the binder resin 11 is not limited to a particular material, and conventionally used materials and thermoplastic resins made of various kinds of natural and synthetic polymer materials may be used. For example, a resin or a mixture of resins having a weight-average molecular weight of approximately 5,000 to approximately 100,000 and a melting point of approximately 90 to approximately 140° C. selected from epoxy resins, styrene-acrylic resins, polyamide resins, polyester resins, polyvinyl resins, polyurethane resins, polybutadiene resins and the like may be used for the binder resin 11.

The coloring agent 14 included in the color toner 10 is also not limited to a particular material, and conventionally used dyes, pigments and the like may be used For example, quinacridone (red), phthalocyanine (blue, etc.), anthraquinone (red), diazo (red or yellow), monoazo (red), anilide-based compound (yellow), benzidine (yellow), benzimidazalone (yellow, phthacyanine halide (green) and the like may be used for the coloring agent 14.

The material used for the charge control agent 15 is not limited to a specific material, as long as the charge of the color toner 10 can appropriately be controlled. However, in the case of the color toner 10 which is used for forming color images, it is desirable that the charge control agent 15 is achromatic or only has a light color. Preferably, nigrosine dye (black), quaternary ammonium salt (achromatic), triphenylmethane derivative (blue) or the like may be used for the charge control agent 15 when forming a positive polarity charge control agent. In addition, metal naphthol complex (achromatic), metal salicylate complex (achromatic), a boron-based compound or the like may be used for the charge control agent 15 when forming a negative polarity charge control agent.

It is possible to externally add an external additive for improving the flowability of the color toner 10. Normally used materials may be used for such an additive. For example, inorganic particulates such as silica, titania, alumina and zinc oxide, resin grains such as polystyrene, polymethyl methacrylate (PMMA) and memelamine resin, and the like may be used for the additive for improving the flowability.

Therefore, in the color toner 10 shown in FIG. 1, the wax 12 is dotted in the form of islands within a sea of the binder agent 11, and the infrared ray absorbing agent 13 is held within the wax 12. The infrared ray absorbing agent 13 is maintained in a dispersed state within the wax 12. As will be described later, it is possible to form a state where the infrared ray absorbing agent 13 is dispersely held within the wax 12 when the wax 12, the infrared ray absorbing agent 13 and the surface-active agent are mixed, melted and mulled during a fabrication process.

The infrared ray absorbing agent 13 may be partially be exposed locally at the surface of the wax 12, but compared to the conventional color toner 20 shown in FIG. 2, it may readily be understood that the possibility of contact between the infrared ray absorbing agent 13 and the charge control agent 15 is greatly reduced in the case of the color toner 10 shown in FIG. 1.

Next, a description will be given of the fabrication process according to the present invention for fabricating the flash fixing toner according to the present invention.

In the present invention, the flash fixing toner must be fabricated to a state such that the infrared ray absorbing agent is held within the wax. Hence, the fabrication methods described in the following include a first step which melts and mixes a wax, an infrared ray absorbing agent and a surface-active agent to obtain a mixture and forms the mixture into a powder of wax grains including the infrared ray absorbing agent, and a second step which mixes the wax grains including the infrared ray absorbing agent, a binder resin, a coloring agent and a charge control agent and forms a powder of color toner grains.

For example, in the first step, the infrared ray absorbing agent, the wax and a sorbitane fatty group ester are mixed, and the mixture is melted and mulled by use of a kneader, a push bench or the like, so as to obtain the wax including the infrared ray absorbing agent. Conditions such as the temperature during this first state are appropriately managed so as to form a state where the infrared ray absorbing agent is satisfactorily dispersed within the wax. Since the wax is to be formed in the color toner in the following second step, a crusher such as a jet mill is used to pre-grind the wax including the infrared ray absorbing agent into grains having a desired grain diameter.

In the second step, the wax grains including the infrared ray absorbing agent and obtained by the first step are used to form the color toner by a process similar to that used when fabricating the conventional color toner. The only difference between the process carried out by this second step and the corresponding conventional process is that this second step uses the wax grains including the infrared ray absorbing agent and obtained by the first step, and the process of the second step is otherwise the same as the corresponding conventional process. When forming the color toner by this second step, it is possible to employ a grinding method or a polymerization method.

When forming the color toner by the grinding method, the constituent elements of the color toner such as the wax including the infrared ray absorbing agent, the coloring agent and the charge control agent are mixed, and the mixture is melted and mulled using a kneader, a push bench or the like. In this case, the mulling intensity is adjusted so that elution of the infrared ray absorbing agent held within the wax into the binder resin will not occur. Thereafter, the melted and mulled mixture is roughly ground, and then finely ground by a jet mill or the like, so as to obtain the desired toner grain diameter by use of a wind classifier. An appropriate external additive is externally added if necessary, to thereby finally obtain the toner grains of the color toner.

On the other hand, when forming the color toner by the polymerization method, it is possible to adaptively employ a suspension polymerization method or an emulsion polymerization method.

When employing the suspension polymerization method, a monomer composition is formed by mixing a monomer such as styrene, butyl acrylate and 2-ethyl hexyl acrylate, a bridged agent such as divinyl benzene, a chain moving agent such as dodecyl mercaptan, coloring agent, charge control agent, wax composition powder including the infrared ray absorbing agent, and polymerization initiator. Thereafter, the monomer composition is put into a solution containing a surface-active agent and a polymerization stabilizer such as tricalcium phosphate and polyvinyl alcohol, and an emulsion is formed by use of a rotor-stator type emulsification machine, a high-pressure type emulsification machine, an ultrasonic emulsification machine or the like. Then, the monomer is polymerized by heating the emulsion. After the polymerization, the grains are cleaned and dried, and the appropriate external additive is externally added to finally obtain the toner grains of the color toner.

When forming the color toner by the emulsion polymerization method, a monomer such as styrene, butyl acrylate and 2-ethyl hehexyl acrylate, and if necessary a surface-active agent such as dolecyl sodium sulfate, are added to a solution containing a water-soluble polymerization initiator such as potassium persulfate, so as to obtain a mixture which is heated while being agitated. As a result, polymerization of the mixture is performed, and resin grains are obtained. Thereafter, the wax composition powder including the infrared ray absorbing agent is added to a suspension in which the resin grains are dispersed, and the pH of the suspension, agitation intensity, temperature and the like are adjusted so that a hetero-flocculation of the resin grains and the wax composition powder including the infrared ray absorbing agent occurs. Furthermore, the hetero-flocculation mixture is heated to a temperature greater than or equal to a glass transition temperature of the resin, so as to obtain the toner grains by melting the hetero-flocculation mixture. Then, the grains are cleaned and dried, and the appropriate external additive is externally added to finally obtain the toner grains of the color toner.

Next, a description will be given of embodiments of the flash fixing toner of the present invention.

First Embodiment

In the first step, 60 weight percent (wt. %) of a wax (HNP-9 manufactured by Nihon Seiro Company of Japan) and having a softening temperature of 75° C., 40 wt. % of aminium-salt-based compound (N,N,N',N'-tetrakis (p-dibuthylamino) p-phenylene diamine chlorate aminium-salt manufactured by Teikoku Kagaku Company of Japan), and 0.3 wt. % of sorbitane fatty group ester (Ionet S-85 manufactured by Sanyo Kasei Company of Japan) were mixed, and then melted and mulled, so as to obtain the wax including the infrared ray absorbing agent. Thereafter, the wax including the infrared ray absorbing agent was ground, so as to obtain a powder of the wax including the infrared ray absorbing agent. The wax powder obtained will be referred to as wax-A.

A surfonic acid converted polyester resin having a softening temperature of 104° C., an acid value of 30 mg/KOH, and an ethylene oxide additive of bisphenol-A and terephthalic acid, and a bis (4-hydroxyphenyl) surfonic acid as essential constituent monomers, was used for the binder resin. In the second step, 5 wt. % of phthalocyanine pigment (B2G manufactured by Clariant Company of Japan) is added as the blue-based coloring agent, 3 wt. % of Calixarene-based compound (E-89 manufactured by Orient Company of Japan), and 4 wt. % of the wax-A were added to the binder resin, and the mixture was melted and mulled. The mixture was further ground and classified, to obtain a flash fixing color toner base 10-1.

When this toner base 10-1 was mixed with a ferrite carrier having a grain diameter of 60 μm at a toner density of 4.5%, agitated for 10 minutes, and the charge thereof was then measured by a blow-off charge measuring device manufactured by Toshiba Chemical Company of Japan, the measured charge obtained was −9 μC/g.

In order to make the toner base 10-1 suited for practical use, 0.35 wt. % of hydrophobic silica (H-2000 manufactured by Clariant Company of Japan) was added as an external additive. The toner base 10-1 was then mixed with a ferrite carrier having a grain diameter of 60 μm at a toner density of 4.5% to form a developing agent, and the charge thereof was measured by the blow-off charge measuring device manufactured by Toshiba Chemical Company of Japan. The measured charge was −12 μC/g.

This developing agent was used in a printer (model F6718K manufactured by Fujitsu Limited of Japan), to check the flash fixing performance and the image quality of the prints made. As a result, it was confirmed that a satisfactory image quality having virtually no fog can be obtained, and that a high fixing performance of 90% can be obtained according to a tape separation test.

The tape separation test was carried out as follows. First, an image printing tone on a plain paper having a toner image fixed thereon by the printing was measured as the optical density. Then, a separating tape was adhered on the print, that is, a toner image fixed on a recording medium such as plain paper. A "Scotch Mending Tape" (product name) manufactured by Sumitomo 3M Company of Japan was used as the separating tape. The adhered separating tape was then removed, and the optical density on the plain paper after the removal was measured. The image printing tone on the plain paper after the removal of the separating tape was represented by a percentage with respect to the image printing tone on the plain paper before the removal of the separating tape, where the image printing tone before the removal is represented by 100. The change in the image printing tone, represented by the percentage of the image printing tone after the removal of the separating tape with respect to the image printing tone before the removal of the separating tape, was used as the fixing performance for evaluating the strength of the fixing. A Macbeth PCM meter was used for the measurement of the optical density.

Comparison Example 1

Unlike the Embodiment 1 described above, no sorbitane fatty group ester was used as the surface-active agent. Instead, 60 wt. % of a wax (HNP-9 manufactured by Nihon Seiro Company of Japan) and 40 wt. % of aminium-salt-based compound (N,N,N',N'-tetrakis (p-dibuthylamino) p-phenylene diamine chlorate aminium-salt manufactured by Teikoku Kagaku Company of Japan) were mixed, melted and mulled. In this case, a satisfactory compound could not be obtained due to phase separation of the wax and the aminium-salt-based compound.

As a result, it was confirmed that the infrared ray absorbing agent was held within the wax and the sorbitane fatty group ester which was used as the surface-active agent effectively functioned in the case of the Embodiment 1.

Comparison Example 2

The same materials were used as in the Embodiment 1, but the fabrication method was changed to fabricate the color toner in one mixing, melting and mulling process.

In other words, a surfonic acid converted polyester resin having an acid value of 30 mg/KOH, and an ethylene oxide additive of bisphenol-A and terephthalic acid, and a bis (4-hydroxyphenyl) surfonic acid as essential constituent monomers, was used for the binder resin. Then, 5 wt. % of phthalocyanine pigment (B2G manufactured by Clariant Company of Japan), 3 wt. % of Calixarene-based compound (E-89 manufactured by Orient Company of Japan), 2.4 wt. % of a wax (HNP-9 manufactured by Nihon Seiro Company of Japan), and 1.6 wt. % of aminium-salt-based compound (N,N,N',N'-tetrakis (p-dibuthylamino) p-phenylene diamine chlorate aminium-salt manufactured by Teikoku Kagaku Company of Japan) were added to the binder resin, and the mixture was melted and mulled. The mixture was further ground and classified, to obtain a flash fixing color toner base 10-2.

When this toner base 10-2 was mixed with a ferrite carrier having a grain diameter of 60 μm at a toner density of 4.5%, agitated for 10 minutes, and the charge thereof was then measured by the blow-off charge measuring device manufactured by Toshiba Chemical Company of Japan, similarly as in the case of the toner base 10-1 of the Embodiment 1, the measured charge obtained was −3 μC/g. This measured charge was reduced to ⅓ the charge obtained by the toner base 10-1 of the Embodiment 1.

In order to make the toner base 10-2 suited for practical use, 0.35 wt. % of hydrophobic silica (H-2000 manufactured by Clariant Company of Japan) was added as an external additive. The toner base 10-2 was then mixed with a ferrite carrier having a grain diameter of 60 μm at a toner density of 4.5% to form a developing agent, and the charge thereof was measured by the blow-off charge measuring device manufactured by Toshiba Chemical Company of Japan. The measured charge was −5 μC/g. Hence, the charge of the developing agent was reduced to 5/12 the charge obtained by the developing agent of the Embodiment 1.

This developing agent was used in a printer (model F6718K manufactured by Fujitsu Limited of Japan), to check the flash fixing performance and the image quality of the prints made. As a result, it was confirmed that considerable fog is generated and a satisfactory image quality cannot be obtained, and that a satisfactory fixing performance cannot be obtained according to the tape separation test.

It may be regarded that the color toner of this Comparison Example 2 is in the state shown in FIG. 2. In other words, it may be regarded that the charge greatly deteriorated because the charge control agent contacts the infrared ray absorbing agent which is not held within the wax, and the mutual reaction caused by the contact deteriorates both the charge control characteristic and the infrared absorption, to thereby deteriorate the image quality and the fixing performance.

Embodiment 2

A red-based coloring agent was used to fabricate the color toner, in place of the blue-based coloring agent used in the Embodiment 1.

The same binder resin was used as in the Embodiment 1. In addition, 6 wt. % of naphthol pigment (FBB02 manufactured by Clariant Company of Japan) is added as the red-based coloring agent, 3 wt. % of Calixarene-based compound (E-89 manufactured by Orient Company of Japan), and 4 wt. % of the wax-A used in the Embodiment 1 were added to the binder resin, and the mixture was melted and mulled. The mixture was further ground and classified, to obtain a flash fixing color toner base 10-3.

When this toner base 10-3 was mixed with a ferrite carrier having a grain diameter of 60 μm at a toner density of 4.5%, agitated for 10 minutes, and the charge thereof was then measured by the blow-off charge measuring device manufactured by Toshiba Chemical Company of Japan, the measured charge obtained was −7 μC/g.

In order to make the toner base 10-3 suited for practical use, 0.5 wt. % of hydrophobic silica (H-2000 manufactured by Clariant Company of Japan) was added as an external additive. The toner base 10-3 was then mixed with a ferrite carrier having a grain diameter of 60 μm at a toner density of 4.5% to form a developing agent, and the charge thereof was measured by the blow-off charge measuring device manufactured by Toshiba Chemical Company of Japan. The measured charge was −12 μC/g.

This developing agent was used in the printer (model F6718K manufactured by Fujitsu Limited of Japan), to check the flash fixing performance and the image quality of the prints made. As a result, it was confirmed that a satisfactory image quality having virtually no fog can be obtained, and that a high fixing performance of 90% can be obtained according to the tape separation test.

From the Embodiments 1 and 2 described above, it was confirmed that the color toners of the Embodiments 1 and 2 can be used to form a clear image having a high quality and a high fixing performance, regardless of the kinds of coloring agents used.

Comparison Example 3

A wax having a softening temperature higher than the softening temperature of the binder resin was used in this Comparison Example 3.

In this Comparison Example 3, 60 wt. % of a wax (Biscol 55P manufactured by Sanyo Kasei Company of Japan) and having a softening temperature of 150° C., 40 wt. % of aminium-salt-based compound (N,N,N',N'-tetrakis (p-dibuthylamino) p-phenylene diamine chlorate aminium-salt manufactured by Teikoku Kagaku Company of Japan), and 0.3 wt. % of sorbitane fatty group ester (Ionet S-85 manufactured by Sanyo Kasei Company of Japan) were mixed, and then melted and mulled, so as to obtain the wax including the infrared ray absorbing agent. Thereafter, the wax including the infrared ray absorbing agent was ground, so as to obtain a powder of the wax including the infrared ray absorbing agent. The wax powder obtained will be referred to as wax-B.

A toner base 10-4 was fabricated using the wax-B, similarly to the Embodiment 2 described above, except that the wax-B was used in place of the wax-A, and more particularly, by adding 4 wt. % of the wax-B.

Furthermore, similarly as in the case of the Embodiment 2, in order to make the toner base 10-4 suited for practical use, 0.5 wt. % of hydrophobic silica (H-2000 manufactured by Clariant Company of Japan) was added as an external additive. The toner base 10-4 was then mixed with a ferrite carrier having a grain diameter of 60 μm at a toner density of 4.5% to form a developing agent, and the charge thereof was measured by the blow-off charge measuring device manufactured by Toshiba Chemical Company of Japan. The measured charge was -12 μC/g.

This developing agent was used in the printer (model F6718K manufactured by Fujitsu Limited of Japan), to check the flash fixing performance and the image quality of the prints made. As a result, it was confirmed that a satisfactory image quality having virtually no fog can be obtained, but a fixing performance of 80% was obtained according to the tape separation test. Although the fixing performance of 80% is still satisfactory, this fixing performance was slightly deteriorated compared to that of the Embodiment 2.

In the Comparison Example 3, the contact between the infrared ray absorbing agent and the charge control agent is suppressed, similarly to the Embodiment 2, and the infrared absorption and the charge control characteristic will not be deteriorated by a reaction between the infrared ray absorbing agent and the charge control agent. Accordingly, it may be regarded that the infrared absorption and the charge control characteristic of the color toner are satisfactory. However, it may be regarded that the fixing performance is slightly deteriorated because of the increase in the softening temperature of the wax which holds therein the infrared ray absorbing agent. For this reason, it was confirmed that, from the point of view of improving the fixing performance, it is desirable to use a wax having a softening temperature lower than the softening temperature of the binder resin.

Based on the above, the present inventors have found that, when sorbitane fatty group ester, polyether. polyol, alkyl-polyoxyethylene-based surface-active agent. alkyl-phenyl-polyoxyethylene- based surface-active agent or the like is used as the surface-active agent, it is desirable to add the surface-active agent in a range of approximately 0.001 to approximately 1 wt. % o with respect to the wax.

In the embodiments described above, the tests were conducted with respect to the two-component developing agents using the carriers. However, the present invention is of course similarly applicable to single-component developing agents.

Further, the present invention is not limited to these embodiments, but various variations and modifications may be made without departing from the scope of the present invention.

What is claimed is:

1. A flash fixing toner comprising:

a binder resin;

a coloring agent;

a charge control agent;

a wax;

an infrared ray absorbing agent; and a surface-active agent within said wax, said infrared ray absorbing agent being made of an aminium-salt-based compound and or a diimonium-salt-based compound, and being held within said wax.

2. The flash fixing toner as claimed in claim 1, wherein said surface-active agent is made of a material selected from the group consisting of sorbitane fatty group ester, polyether, polyol, alkyl-polyoxyethylene-based compound, and alkyl-phenyl-polyoxyethylene-based compound.

3. The flash fixing toner as claimed in claim 1, wherein said coloring agent is outside said wax.

4. The flash fixing toner as claimed in claim 1, wherein said charge control agent is outside said wax.

5. The flash fixing toner as claimed in claim 1, wherein said coloring agent and said charge control agent are outside said wax.

6. The flash fixing toner as claimed in claim 1, wherein said infrared ray absorbing agent is selectively embedded within said wax and/or partially exposed from a surface of said wax.

7. A flash fixing toner comprising:

a binder resin;

a coloring agent;

a charge control agent;

a wax;

an infrared ray absorbing agent; and a surface-active agent within said wax, said infrared ray absorbing agent being made of an aminium-salt-based compound and/or a diimonium-salt-based compound, and being held within said wax, said wax being dotted in a form of islands within said binder resin.

8. The flash fixing toner as claimed in claim 7, wherein said wax is made of a material or a mixture of materials selected from the group consisting of polyolefins, fatty esters, paraffin wax, caranuba wax, amide-based wax and acid-converted polyethylene.

9. The flash fixing toner as claimed in claim 7, wherein said surface-active agent is made of a material selected from the group consisting of sorbitane fatty group ester, polyether, polyol, alkyl-polyoxyethylene-based compound, and alkyl-phenyl-polyoxyethlene-based compound.

* * * * *